US008733004B2

(12) United States Patent
Andrulewich

(10) Patent No.: US 8,733,004 B2
(45) Date of Patent: May 27, 2014

(54) PICTURE FRAME MOULDING WITH MATBOARD TRACK

(75) Inventor: Michael Andrulewich, Jersey City, NJ (US)

(73) Assignee: Nielsen Bainbridge, Paramus, NJ (US)

( * ) Notice: Subject to any disclaimer, the term of this patent is extended or adjusted under 35 U.S.C. 154(b) by 0 days.

(21) Appl. No.: 13/086,998

(22) Filed: Apr. 14, 2011

(65) Prior Publication Data

US 2012/0260548 A1 Oct. 18, 2012

(51) Int. Cl.

| | |
|---|---|
| ***A47G 1/06*** | (2006.01) |
| ***B44C 5/02*** | (2006.01) |
| ***G09F 1/12*** | (2006.01) |

(52) U.S. Cl.

CPC .... *A47G 1/06* (2013.01); *B44C 5/02* (2013.01)
USPC ..... 40/768; 40/743; 40/792; 40/604; 40/735; 40/732; 40/798; 40/790; 40/765; 40/797; 40/776; 40/772; 40/791; 40/799; 40/800

(58) Field of Classification Search

CPC ..... A47G 1/06; B44C 5/02
USPC ..... 40/768, 743, 792, 604, 735, 732, 798, 40/790, 765, 797, 776, 772, 791, 799, 800
See application file for complete search history.

(56) References Cited

U.S. PATENT DOCUMENTS

| | | | | |
|---|---|---|---|---|
| 59,719 | A * | 11/1866 | Holmes | 40/735 |
| 905,850 | A * | 12/1908 | Craig | 40/788 |
| 2,223,674 | A * | 12/1940 | Cohen | 40/799 |
| 2,602,254 | A * | 7/1952 | Diekmann | 40/768 |
| 2,966,755 | A * | 1/1961 | Knox | 40/790 |
| 3,570,160 | A * | 3/1971 | Spertus | 40/765 |
| 6,233,859 | B1 * | 5/2001 | Kilpatrick et al. | 40/790 |
| 6,305,112 | B1 * | 10/2001 | Hansen | 40/743 |

FOREIGN PATENT DOCUMENTS

| | | |
|---|---|---|
| EP | 2044866 | 4/2009 |
| JP | 08-280499 | 10/1996 |
| JP | 2001-258703 | 9/2001 |

OTHER PUBLICATIONS

International Search Report & Written Opinion dated Dec. 10, 2012 for PCT/US2012/024515.

* cited by examiner

*Primary Examiner* — Syed A Islam
(74) *Attorney, Agent, or Firm* — Kevin L. Daffer; Daffer McDaniel, LLP

(57) ABSTRACT

A picture frame molding according to one embodiment includes an elongated body that has an exterior wall, a first channel formed therein for receiving a first member, and a second channel formed therein for receiving a second member. The first and second channels are at least substantially parallel to one another. The elongated body also includes an interior angled wall that is joined to the exterior wall and is formed at an angle thereto. The interior angled wall includes a track that receives an object, such as matboard. The track faces away from the exterior wall and is formed between and at an angle to the first and second channels.

22 Claims, 4 Drawing Sheets

PICTURE FRAME MOULDING WITH MATBOARD TRACK

TECHNICAL FIELD

The present invention relates to frames for hanging pictures, drawings or the like and in particular, to a picture frame moulding that creates a shadowbox appearance.

BACKGROUND

A picture frame is a housing or structure for a picture, such as a painting or photograph, intended to enhance it, make it easier to display, and/or protect it. Varieties of picture frame structures are in use today or have been suggested for use. Picture frames can come in any number of different shapes and can be formed from any number of different materials. The most common shape of a frame is a rectangle; however, frames can come in other shapes, such as square or oval, etc.

For pieces to be framed under glass, except for the most disposable and inexpensive posters or temporary displays, the glass must be raised off the surface of the paper. This is done by means of matting, a lining of plastic "spacers", shadowboxing, stacking two mouldings with the glass in between, and various other methods. If the paper (or other media) were to touch the glass directly, any condensation inside the glass would absorb directly into the art, having no room to evaporate. This is harmful to almost any medium. It causes art sticking to the glass, mildew, and other ill effects. Raising the glass is also necessary when a piece is done in a loose media such as charcoal or pastel, to prevent smudging. Care should be taken with these works, however, if Plexiglas is used as a static charge can build up which will attract the pigment particles off the paper. Using real glass helps to prevent this. Certain kinds of pieces do not usually need glass when framed, including paintings done in acrylic or oil paint (the former is usually waterproof; the latter actually needs to "breathe" due to the decades-long drying process), tiles, etc.

One other type of art structure or frame construction is a shadowbox which is a framed box, usually square or rectangular in shape, with a glass front that it is used for displaying and protecting valued items. Often, a shadowbox looks similar to a framed picture or painting, but rather than simply displaying a picture behind glass, a shadowbox is a shallow box full of treasured or important items. Typically, the shadowbox is defined by a square-shaped frame formed of upstanding walls that extend outwardly from a rear wall (floor). A shadowbox can display two or three dimensional objects.

There is a need to provide a frame or moulding construction that provides a shadowbox like appearance while not in fact having a traditional shadowbox construction.

SUMMARY

In accordance with one embodiment, a picture frame moulding is provided and includes an elongated body that has an exterior wall, a first channel formed therein for receiving a first member, and a second channel formed therein for receiving a second member. The first and second channels are at least substantially parallel to one another. The elongated body also includes an interior angled wall that is joined to the exterior wall and is formed at an angle thereto. The interior angled wall includes a track that receives a two or three-dimensional object, such matboard or a similar structure as described herein. The track faces away from the exterior wall and is formed between and at an angle to the first and second channels.

In another embodiment, a picture frame assembly that has a shadowbox appearance is formed of a plurality of picture moulding pieces that are arranged and coupled to one another to define an enclosed frame. Each moulding piece has an elongated body that includes an exterior wall, a first channel formed therein, and a second channel formed therein. The first and second channels are at least substantially parallel to one another. The moulding piece also includes an interior angled wall that is joined to the exterior wall and is formed at an angle thereto. The interior angled wall includes a track that receives a two or three-dimensional object, such as matboard. The track faces away from the exterior wall and is formed between and at an angle to the first and second channels. The picture frame also includes a substrate that is disposed within the first channel and extends across the enclosed frame and a sheet of transparent material that is disposed within the second channel and extends across the enclosed frame so as to protect an object that is disposed along the substrate.

These and other aspects, features and advantages shall be apparent from the accompanying Drawings and description of certain embodiments of the invention.

DETAILED DESCRIPTION OF CERTAIN EMBODIMENTS OF THE INVENTION

Figure 1:
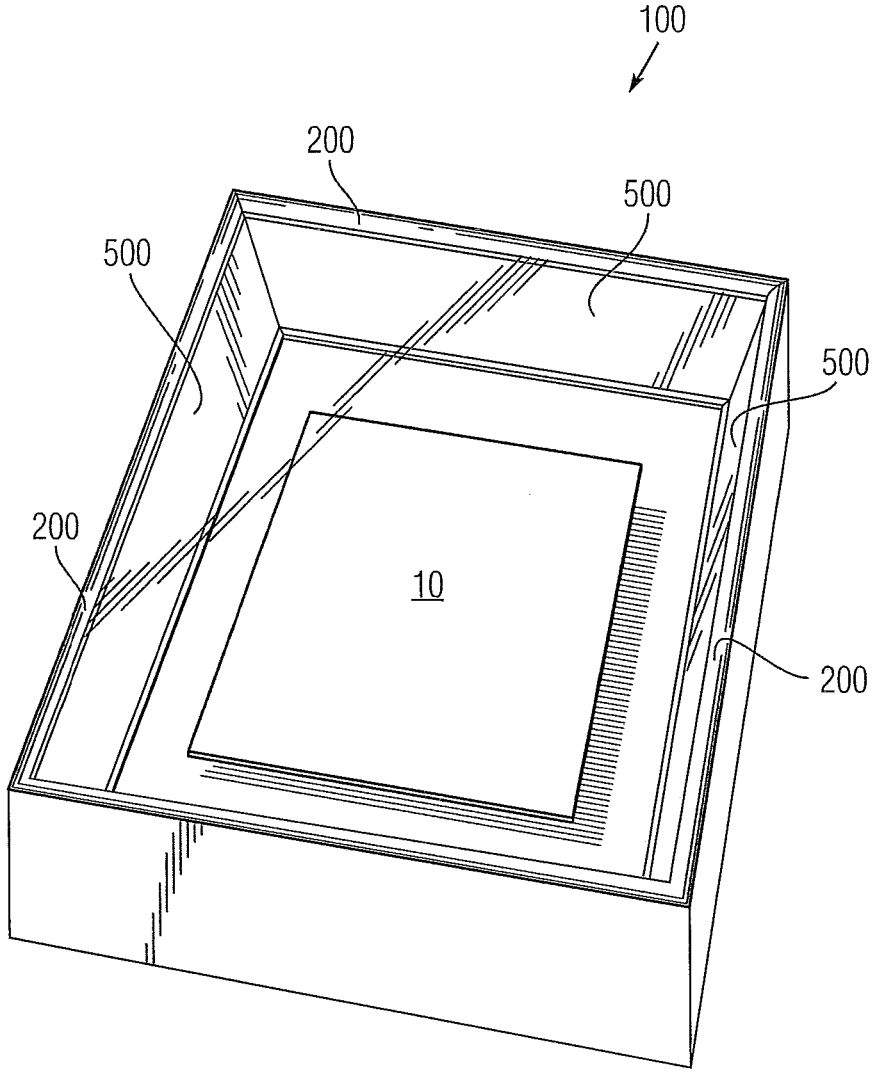
FIG. 1 is a front and side perspective view of an assembled picture frame that includes a track moulding according to a first embodiment.

FIG. 1 shows an assembled picture frame 100 that resembles and gives the appearance of being a shadowbox while not in fact having a conventional shadowbox construction. The frame 100 can be used to display one or more objects, such as a two or three dimensional object 10, that are traditionally used in combination with traditional shadowboxes. For example, the object 10 can be a two dimensional picture or photo or can be a three-dimensional sculpture or the like. The frame 100 is formed of moulding pieces that mate together to form an enclosed structure and in the illustrated embodiment, the frame 100 has a square shape. It will be appreciated that the frame 100 can have other shapes that form an enclosed structure, with one alternative frame structure having a rectangular shape. In accordance with the present invention, the frame 100 is formed of pieces of moulding 200.

With reference to FIGS. 1-7, the moulding 200 is configured to receive a number of different components that are part of the frame 100 and more specifically, the moulding 200 is constructed to not only receive a protective sheet of glass or other protective transparent material but also a plurality of pieces of a two or three dimensional object, such as matboard as described below.

Figure 4:
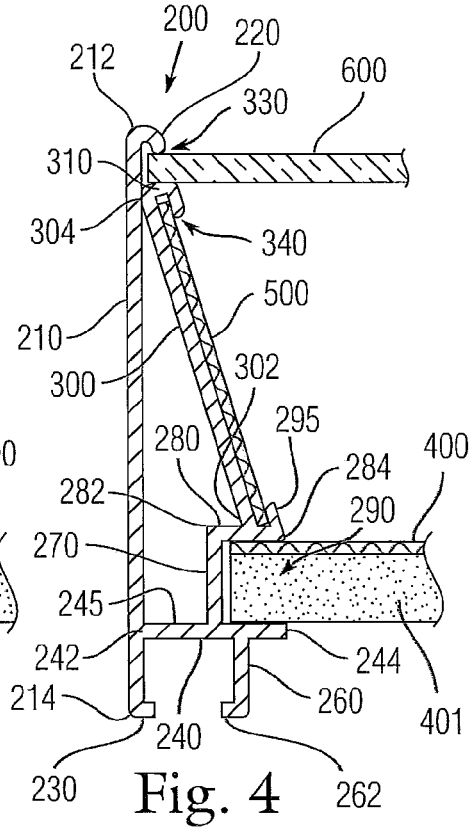
FIG. 4 is a cross-sectional view of track moulding in accordance with another embodiment of the present invention.

FIG. 4 shows a cross-sectional view of the moulding 200. The moulding 200 is generally formed of a number of walls that are positioned relative to one another and joined to one another at select points so as to not only form the exterior walls of the frame 100 but also define operative channels as discussed herein. More specifically, the moulding 200 includes an exterior wall 210 that has a first end 212 and an opposing second end 214. The exterior wall 210 is a generally planar wall with the exception that the first end 212 includes an inwardly curved section (a lip) 220. At the second end 214, the exterior wall 210 has an inwardly directed lip 230. Unlike the curved section 220, the lip 230 is planar in nature and is formed at a right angle to the exterior wall 210 and thus is L-shaped.

The moulding 200 also includes a transverse wall 240 that has a first end 242 that intersects and is joined to the exterior wall 210 and an opposing second end 244. The second end 244 is a free end. The transverse wall 240 has a smooth top surface 245 and a shoulder is formed between the transverse wall 240 and the exterior wall 210. The shoulder is a right angle shoulder.

The moulding 200 also includes a leg 260 that protrudes downwardly from the transverse wall 240 and includes an inwardly directed lip 262 that is complementary to the lip 230 with a space or channel 235 formed therebetween. The leg 260 and lip 262 is thus an L-shaped structure. The lips 230, 262 are coplanar.

As shown in FIG. 4, the moulding 200 can include an upstanding wall 270 that extends upwardly from the top surface 245 of the transverse wall 240. The upstanding wall 270 is formed at a right angle relative to the top surface 245 and thus, the upstanding wall 270 is parallel to the exterior wall 210. In the illustrated embodiment, the upstanding wall 270 is located between the leg 260 and the exterior wall 210.

The moulding 200 also includes a second transverse wall 280 that is parallel to the transverse wall 240. A first end 282 of the wall 280 is joined to the upstanding wall 270 and a second end 284 that is a free end. In the embodiment of FIG. 4, the free end 284 is generally aligned with the free second end 244 in that the ends 284, 244 generally terminate at points that lie in a plane that is parallel to the plan containing the upstanding wall 270. Right angle shoulders are formed between the second transverse wall 280 and the upstanding wall 270 and the transverse wall 240 and the upstanding wall 270. The upstanding wall 270 and the transverse walls 280, 240 define a channel 290 with the transverse wall 240 being a floor and the transverse wall 280 being a ceiling.

At the free end 284 of the second transverse wall 280, an angled lip 295 is formed and extends upwardly and in the direction toward the exterior wall 210 (and thus toward the upstanding wall 270). The angled lip 295 and wall 240 resemble half of an arrow. The angled lip 295 thus extends in a direction opposite the transverse wall 240.

The moulding 200 also includes an angled wall 300 that extends between the second transverse wall 280 and the exterior wall 210. In other words, the angled wall 300 includes a first end 302 that is joined to the second transverse wall 280 and a second end 304 that is joined to the exterior wall 210. The angled wall 300 can be formed at any number of different angles including angles other than 90 degrees relative to the exterior wall 210 and relative to the wall 240; however, it will be appreciated that in some embodiments, the angled wall 300 can be formed at a 90 degree angle relative to the wall 240 and wall 280. In the embodiment where the angled wall 300 is formed at a 90 degree angle relative to the walls 240, 280, the angled wall 300 thus resembles a vertical wall that is parallel to the exterior wall 210.

The angled wall 300 is generally planar from end 302 to end 304 with the exception that at the second end 304, a curved lip 310 is formed. The curved lip 310 is complementary to and similar in construction to the curved lip 220. The lips 220, 310 are thus curved and extend away from the exterior wall 210. Between the lips 220, 310, a space or channel 330 is formed. It will be appreciated that a top surface of the curved lip 310 can include a flat so as to define a smooth planar surface that faces the other lip 220. In this manner and as described below, when an object is inserted into the channel 330, the object can seat flush against the top planar surface of the lip 310 and the lip 220 in effect pinches and holds object in place. The lip 310 includes an inwardly directed lip portion 303 that extends toward the lip 295.

As shown in FIG. 4, a space or channel 340 is formed between the angled lip 295 and the wall 300 and between the lip portion 303 and the angled wall 300. The dimensions (width) of the channel 340 is at least substantially the same so as to permit an object to be received simultaneously in both channels 340. In other words, the channel 340 defines a common track formed along the length of the angled wall 300.

The lips 220, 310 thus represent retaining or catch members that hold a member (e.g., a matboard) in place against the angled wall 300 and thus, a track is formed along the angled wall 300. The moulding 200 can thus be thought of as being a track moulding that receives a plurality of objects within the defined channel. As discussed herein, the channel 340 defined within the wall 300 can receive any number of different objects, including matboard pieces as shown or a variety of other sheetgoods, three-dimensional materials or mounting hardware. Thus, while the drawings show matboard, it will be appreciated that the moulding 200 is not limited to being used with matboard but rather can be used with any number of other objects, including other objects as mentioned above. In the assembled frame 100 that is formed using joined pieces of moulding 200, with the angled walls 300 facing inward.

In the assembled frame 100, a first matboard 400 (which can include a foamboard backing 401) is received within the channel 290 that is formed between the walls 240, 280 and thus extends across the frame 100. The layered structure defined by the first matboard 400 and backboard 401 thus seats against the top surface 245 of the transverse wall 240 and against an underside of the second transverse wall 280. As will be appreciated, an object such as a picture can be mounted to the first matboard 400. The first matboard 400 is a single piece of matboard that is mated to and secured to the frame 100 by taking the pieces of moulding 200 and inserting the exposed edges of the first matboard 400 into the channels 290 of the moulding pieces 200.

A second matboard 500 is disposed within the channel 340 (i.e., in the common matboard track) so as to position the second matboard 500 against and along the length of the angled wall 300 of each piece of moulding 200. As mentioned above, the channels 340 thus represents a matboard track that receives the second matboard 500, with the second matboard 500 being positioned at an angle relative to the first matboard 400. The second matboard pieces 500 are thus peripherally arranged about the first matboard 400 so as to surround the first matboard 400 and in effect create a border around the first matboard 400.

In addition, a sheet of glass or a sheet of protective plastic material 600 is received within the channel 330 that is formed between the lips 220, 310 and extends across the frame 100 to protect the underlying objects. The glass 600 is thus located above the angled second matboard pieces 500.

Figure 5:
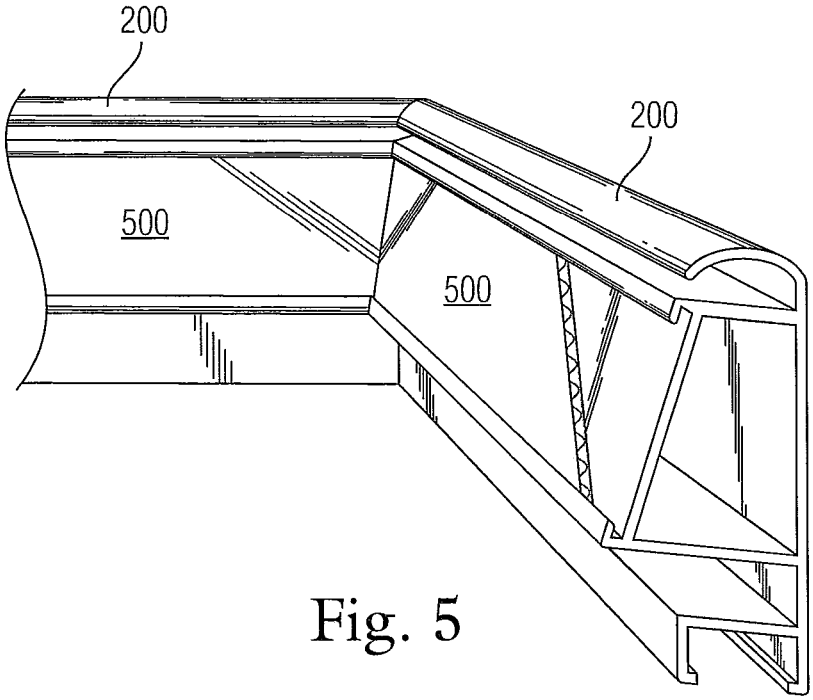
FIG. 5 is a perspective view of a corner of the display case.
Figure 6:
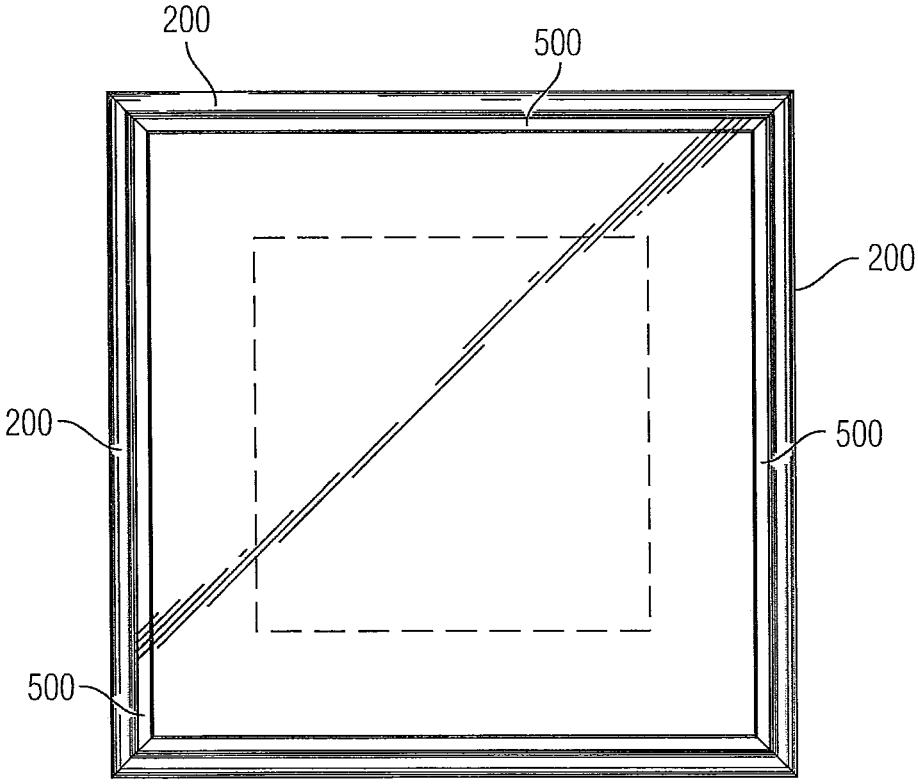
FIG. 6 is a front elevation view of the assembled picture frame.
Figure 7:
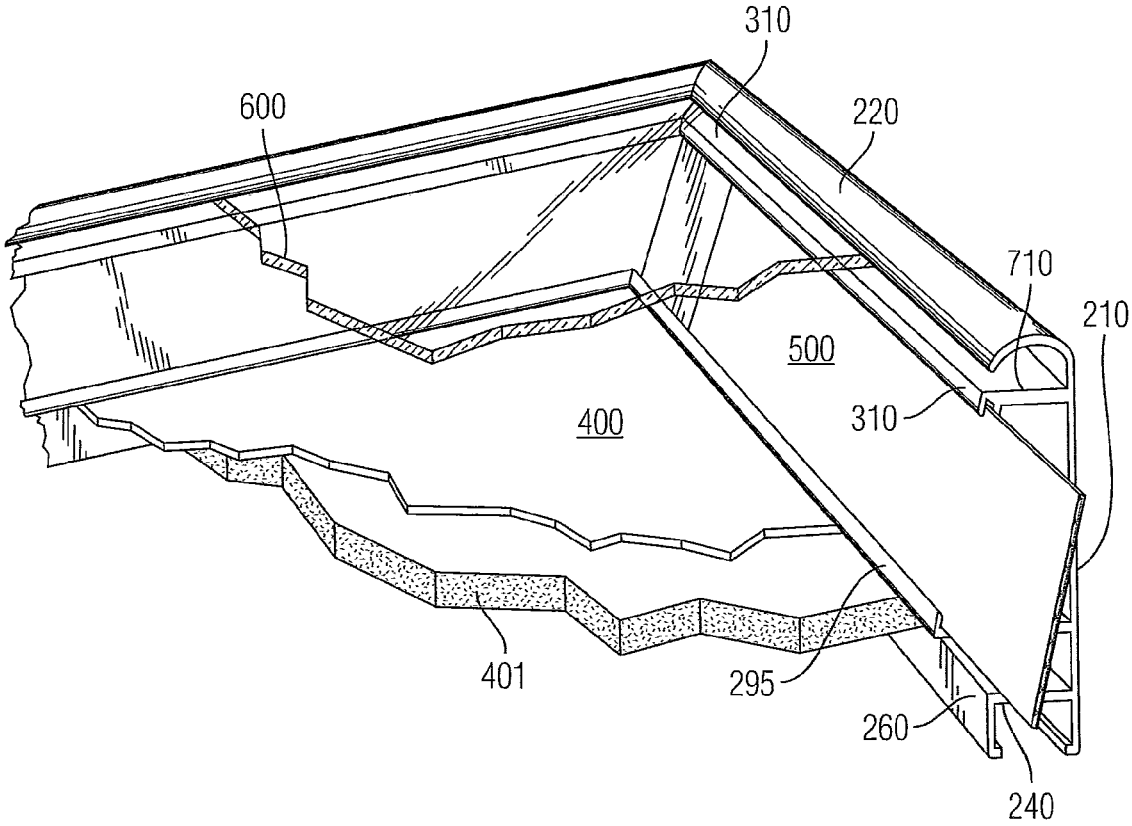
FIG. 7 is cross-sectional view of a corner portion of the assembled picture frame showing the track moulding with glass and matboard installed therein.

FIG. 5 shows one corner of the assembled frame 100 and it will be seen that the interior walls, namely, walls 300, are angled and the second matboard pieces 500 in the track formed along the walls 300 meet in the corner of the frame in a nice clean manner so as to present a clean appearance.

In accordance with the present invention, the moulding 200 can be formed in a common manufacturing process, such as a common moulding process (e.g., injection moulding, etc.). However, other manufacturing techniques can be used. The moulding 200 can be formed from any number of suitable materials.

Figure 2:
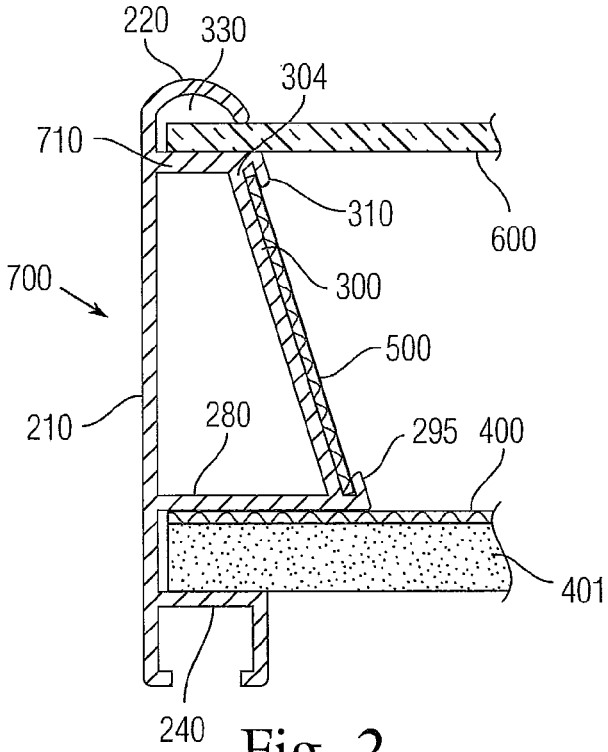
FIG. 2 is a cross-sectional view of track moulding in accordance with one embodiment of the present invention.

Now referring to FIG. 2 which shows a moulding 700 that is similar to the moulding 200 and therefore, like elements are numbered alike. One difference between the moulding 700 and the moulding 200 is that in the moulding 700, the angled wall 300 does not extend all the way to the exterior wall 210 but rather the second end 304 of the angled wall 300 terminates at and is joined to another transverse wall 710 that extends outwardly from the exterior wall 210. The transverse wall 710 is integrally joined to the exterior wall 210 at an opposite end relative to where the wall 710 joins the angled wall 300. The transverse wall 710 is parallel to the transverse walls 240, 280. The transverse wall 280 extends out the furthest from the exterior wall 210 due to the angled wall 300 having an inward bevel towards the top of the exterior wall 210.

Since the second end 304 of the angled wall 300 is in effect spaced further away from the exterior wall 210 in the moulding 700 compared to the moulding 200, the angle of the angled wall 300 can differ between the two mouldings 200, 700. For example, the angled wall 300 in the moulding 700 can have a steeper incline relative to the angled wall 300 in the moulding 200.

The transverse wall 710 is a planar member and includes a smooth, planar top surface that extends across a top portion of the wall that defines the lip 310 and therefore, an object, such as the glass 600 can seat flush against the planar top surface of the transverse wall 710. The curved portion or lip 220 serves to seat against and an opposite face of the glass 600 so as to pinch and hold the glass 600 in the channel 330 between the lip 220 and the transverse wall 710.

Figure 3:
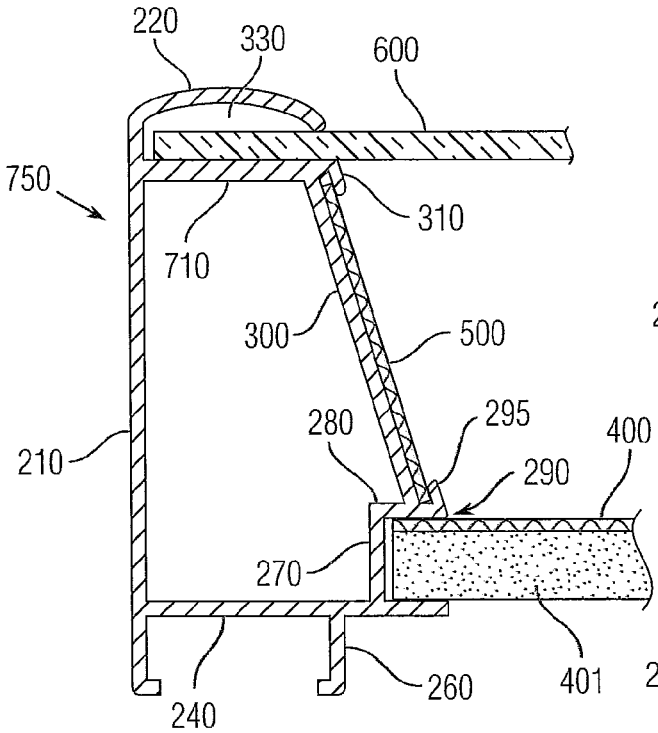
FIG. 3 is a cross-sectional view of track moulding in accordance with another embodiment of the present invention.

FIG. 3 shows a moulding 750 that is similar to both mouldings 200 and 700. Similar to the moulding 200, the moulding 750 includes a channel 290 that is formed between walls 240, 280 and the wall 270 that receives the layered structure 400, 401. The moulding 750 also includes a channel 330 between lip 220 and wall 710 that receives the glass 600. One difference between the moulding 700 and moulding 750 is that the distance between the wall 210 and the angled wall 300 is greater in the moulding 750 so as to create a wider moulding piece. As a result, the lip 220 has a greater size in moulding 750. The moulding 750 can thus be more suitable for larger artwork.

In one embodiment, the angle of the angled wall 300 relative to the horizontal line (wall 240) is at least substantially the same for the three mouldings 200, 700, 750.

In accordance with the present invention, the picture frame moulding 200 includes a track sized to receive matboard and possesses the unique feature of receiving matboard allows a framer to easily create a shadowbox with matboard sides without the use of adhesives. The moulding can be formed to have a profile where the matboard track is placed in an angle wall (wall 300). The angled wall of the profile creates a unique shadowbox effect by not having to have a 90 degree relationship between the interior walls (walls 210) and the backboard (layered matboard and foamboard).

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. A picture frame moulding for placement against a support surface comprising:

an elongated body having:

an exterior wall which defines an outermost exterior surface of the body;

a first channel formed therein for receiving a first member;

a second channel formed therein for receiving a second member, wherein the first and second channels are at least substantially parallel to one another, wherein the first channel is located forward of the second channel further away from the support surface when the picture frame moulding is displayed against the support surface; and an interior angled wall that is joined to the exterior wall and is formed at an angle relative thereto, the interior angled wall including a track that receives an object and is configured to securely hold the object on the track by retention of top and bottom edges of the object, the track facing away from the exterior wall and being formed between and at an angle to the first and second channels, wherein the interior angled wall is integrally joined at a first end thereof to a first wall and is integrally joined at a second end thereof to a second wall which is parallel to the first wall, the first and second walls being integrally and directly joined to the exterior wall, with a hollow space being formed between the first and second walls, the interior angled wall extending between the first and second walls, the first and second walls providing planar surfaces for the first and second members, respectively, wherein the first wall is shorter in length than the second wall such that an angle formed inside the hollow space between the interior angled wall and the second wall is less than 90 degrees.

2. The picture frame moulding of claim 1, wherein the first channel is formed between the first wall and a third wall that is parallel to the first wall, the third wall being integrally joined to the exterior wall.

3. The picture frame moulding of claim 1, wherein the second channel is defined between the second wall and a fourth wall that is integrally joined to the exterior wall.

4. The picture frame moulding of claim 1, wherein the second wall includes an inwardly directed first lip and the first wall includes an inwardly directed second lip that faces the first lip, the first and second lips defining the track and slidingly receiving the object, and serving to hold the object along the angled wall.

5. The picture frame moulding of claim 3, wherein the fourth wall is a curved wall.

6. The picture moulding of claim 3, wherein the body includes a hollow space between the angled wall and the exterior wall.

7. The picture frame moulding of claim 1, wherein the second member comprises a sheet of transparent material and the object comprises matboard.

8. The picture frame moulding of claim 7, wherein the second members is one of a sheet of glass and a sheet of acrylic material.

9. The picture frame moulding of claim 1, wherein the first member comprises a matboard and foamboard layer disposed on a bottom face of the matboard.

10. The picture frame moulding of claim 1, wherein the angle is an angle other than 90 degrees.

11. A picture frame assembly for placement against a support surface comprising:

a plurality of picture moulding pieces that are arranged and coupled to one another to define an enclosed frame, each moulding piece having an elongated body that includes:

an exterior wall which defines an outermost exterior surface of the body:

a first channel formed therein, wherein the first channel is defined by a first planar surface and by an end wall that is parallel to the exterior wall and defines an outer end of the first channel;

a second channel formed therein and being defined by a second planar surface, wherein the first and second channels are at least substantially parallel to one another, wherein an outer end of the second channel is defined by the exterior wall itself, wherein the first channel is located forward of the second channel further away from the support surface when the picture frame moulding is displayed against the support surface; and an interior angled wall that is joined to the exterior wall and is formed at an angle thereto, the interior angled wall extending between the first and second planar surface and including a track that receives an object, the track facing away from the exterior wall and being formed between and at an angle to the first and second channels;

a substrate that is disposed within the first channel and extends across the enclosed frame; and a sheet of transparent material that is disposed within the second channel and extends across the enclosed frame;

wherein the outer ends of both the first and second channels are closer to the exterior wall than the interior angled wall resulting in outer edges of the substrate and sheet of transparent material being disposed closer to the exterior wall than the object received in the track of the interior angled wall and resulting in the object within the track being disposed over sections of the substrate and sheet of transparent material that are spaced from the outer edges thereof, the first planar surface is provided closer to the substrate than the second planar surface, and the first planar surface is configured to be longer in length than the second planar surface such that an angle formed between the interior angled wall and the first planar surface is less than 90 degrees.

12. The picture frame of claim 11, wherein the enclosed frame is one of a square shape and a rectangular shape.

13. The picture frame of claim 11, wherein there are four pieces of moulding that are arranged to define four right angled corners.

14. The picture frame of claim 13, wherein the object comprises matboard and the matboards are disposed in adjacent tracks meet in one respective corner.

15. The picture frame of claim 11, wherein the substrate comprises a matboard and foamboard layered structure.

16. The picture frame of claim 11, wherein the sheet of transparent material comprises one of a sheet of glass and a sheet of transparent plastic material.

17. The picture frame of claim 11, wherein the first channel is formed between first and second parallel walls, a bottom end of the angled wall being joined to the second wall, the first wall defining the first surface.

18. The picture frame of claim 11, wherein the second channel is defined between a third wall that is joined at a first end to the exterior wall and a fourth wall that is joined to the exterior wall at a top end thereof, wherein the third wall be joined to a top end of the angled wall, the third wall defining the second surface.

19. The picture frame of claim 11, wherein an upper edge of the angled wall includes an inwardly directed first lip and a lower edge of the angled wall includes an inwardly directed second lip that faces the first lip, the first and second lips defining the track and slidingly receiving the object, and serving to hold the object along the angled wall.

20. The picture frame of claim 18, wherein the fourth wall is a curved wall.

21. The picture frame of claim 11, wherein the body includes a hollow space between the angled wall and the exterior wall.

22. The picture frame of claim 11, wherein the object comprises matboard that is contained within the tracks of the angled walls provide the enclosed frame with a shadowbox appearance.

* * * * *